US007309254B2

(12) United States Patent
Suzuki et al.

(10) Patent No.: US 7,309,254 B2
(45) Date of Patent: Dec. 18, 2007

(54) CONNECTOR WHICH CAN BE INCREASED IN HOLDING STRENGTH WITH RESPECT TO A SUBSTRATE

(75) Inventors: Mamoru Suzuki, Tokyo (JP); Masaki Yamashita, Tokyo (JP); Kazukuni Hisatomi, Tokyo (JP); Kazuhito Hisamatsu, Tokyo (JP)

(73) Assignee: Japan Aviation Electronics Industry Limited, Tokyo (JP)

( * ) Notice: Subject to any disclaimer, the term of this patent is extended or adjusted under 35 U.S.C. 154(b) by 0 days.

(21) Appl. No.: 11/541,004

(22) Filed: Sep. 29, 2006

(65) Prior Publication Data

US 2007/0072463 A1 Mar. 29, 2007

(30) Foreign Application Priority Data

Sep. 29, 2005 (JP) ..... 2005-285146

(51) Int. Cl.
*H01R 13/66* (2006.01)

(52) U.S. Cl. ..... 439/567; 439/571

(58) Field of Classification Search ..... 439/567, 439/571–573, 607

See application file for complete search history.

(56) References Cited

U.S. PATENT DOCUMENTS 4,943,244 A * 7/1990 Teck et al. ..... 439/567
5,603,639 A * 2/1997 Lai et al. ..... 439/607
5,630,730 A 5/1997 Wang et al.
6,077,115 A * 6/2000 Yang et al. ..... 439/567
6,210,220 B1 * 4/2001 Zhu et al. ..... 439/567
6,299,461 B1 * 10/2001 Zhu et al. ..... 439/76.1
6,579,122 B1 * 6/2003 Chen ..... 439/570

FOREIGN PATENT DOCUMENTS

JP 8-2130743 A 8/1996
JP 2563455 11/1997

* cited by examiner

*Primary Examiner*—Hien Vu
*Assistant Examiner*—X. Chung-Trans
(74) *Attorney, Agent, or Firm*—Frishauf, Holtz, Goodman & Chick, P.C.

(57) ABSTRACT

In a connector to be mounted to a substrate, a strengthening member is coupled to a housing holding a contact The strengthening member is adapted to fix the housing to the substrate and includes a side plate portion extending in a direction away from the substrate in a state where the connector is mounted to the substrate, a top plate portion adjacent to the side plate portion and faced to the substrate, and first and second mounting portions to be attached to the substrate, The first mounting portion extends from an end of the side plate portion adjacent to the substrate in a widthwise direction of the housing perpendicular to a fitting direction in which a mating connector is fitted to the connector. The second mounting portion extends from the top plate portion at a side opposite to a fitting side to be fitted to the mating connector.

5 Claims, 5 Drawing Sheets

CONNECTOR WHICH CAN BE INCREASED IN HOLDING STRENGTH WITH RESPECT TO A SUBSTRATE

This application claims priority to prior Japanese patent application JP 2005-285146, the disclosure of which is incorporated herein by reference.

BACKGROUND OF THE INVENTION

This invention relates to a connector to be mounted to a substrate such as a printed wiring board.

Japanese Utility Model Registration (JP-Y) No. 2563455 discloses a technique of fixing a connector of the type to a wiring board as a substrate. In the disclosed technique, the connector has bolt insertion via holes while the wiring board has through holes. Bolts are inserted through the bolt insertion via holes and the through holes and are engaged with nuts so that the connector is fixed to the wiring board. Further, the connector has hold-down members to be fixed to a conductive portion of the wiring board by soldering. However, it is troublesome to form the through holes in the wiring board. In addition, the number of parts is increased because the bolts and the nuts are used.

Japanese Unexamined Patent Application Publication (JP-A) No. H8-213074 discloses another technique of fixing a connector of the type to a substrate. In the disclosed technique, use is made of a conductive board lock mechanism fixed to a housing having a mounting surface. The board lock mechanism has a first portion having a protruding portion extending beyond the mounting surface and a second portion having a foot connected to a ground trace of a printed circuit board. However, production of the board lock mechanism is complicated because the first and the second portions are formed.

SUMMARY OF THE INVENTION

It is therefore an object of this invention to provide a connector which can be increased in holding strength when the connector is mounted and fixed to a substrate.

It is another object of this invention to provide a connector which can be reduced in number of parts.

Other objects of the present invention will become clear as the description proceeds.

According to an aspect of the present invention, there is provided a connector to be mounted to a substrate. The connector comprises a conductive contact, an insulating housing holding the contact, and a strengthening member coupled to the housing and adapted to fix the housing to the substrate. The strengthening member comprises a side plate portion extending in a direction away from the substrate in a state where the connector is mounted to the substrate, a top plate portion adjacent to the side plate portion and faced to the substrate, and first and second mounting portions to be attached to the substrate. The first mounting portion extends from an end of the side plate portion adjacent to the substrate in a widthwise direction of the housing perpendicular to a fitting direction in which a mating connector is fitted to the connector. The second mounting portion extends from the top plate portion at a side opposite to a fitting side to be fitted to the mating connector.

DESCRIPTION OF THE PREFERRED EMBODIMENTS

Referring to FIGS. 1 to 4, description will be made of an entire structure of a connector according to an embodiment of this invention.

Figure 1:
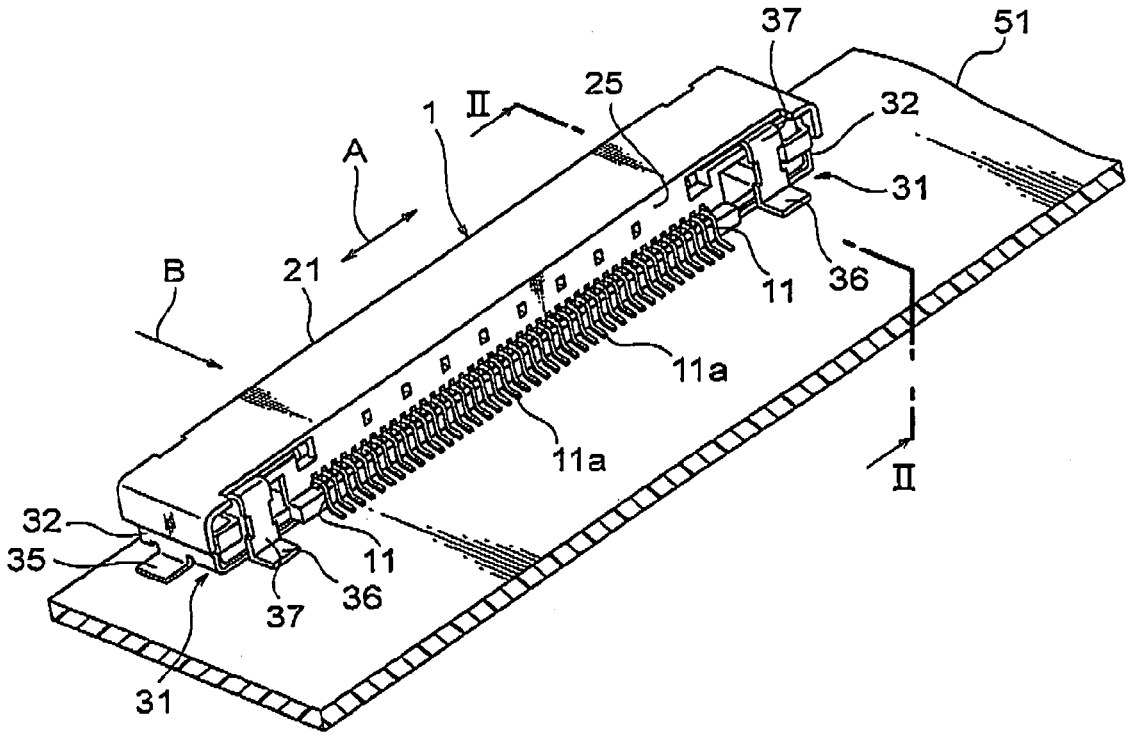
FIG. 1 is a perspective view of a connector according to an embodiment of this invention when the connector is mounted to a substrate.
Figure 2:
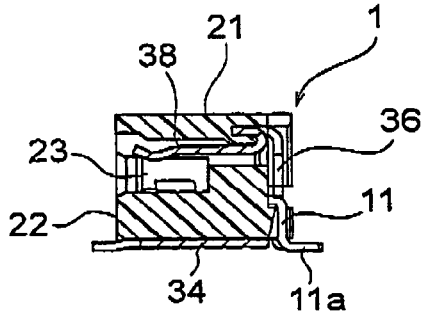
FIG. 2 is a sectional view of the connector taken along a line II-II in FIG. 1.

The connector illustrated in FIGS. 1 and 2 is depicted by a reference numeral 1 and comprises a plurality of conductive contacts 11, an insulating housing 21 holding the contacts 11, and two strengthening members 31 for fixing the housing 21 to a substrate 51 such as a printed wiring board. The housing 21 has a generally rectangular parallelepiped shape. The housing 21 has a front surface 22 provided with a fitting portion 23 in the form of a large groove.

In the housing 21, the contacts 11 are arranged in parallel with a space left from one another in the widthwise direction B. Each of the contacts 11 has a contacting portion (not shown) disposed in the fitting portion 23 and a terminal portion 11*a* extending outward from a rear surface 25 of the housing 21.

The two strengthening members 31 are coupled to opposite ends of the housing 21 in a transversal direction or a widthwise direction A in one-to-one correspondence. The strengthening members 31 are symmetrical in shape with respect to each other. Therefore, only one strengthening member will be described in the following. The strengthening members 31 may be called hold-downs.

The housing 21 with the contacts 11 and the strengthening members 31 held thereon is mounted to the substrate 51. The terminal portions 11*a* of the contacts 11 are connected by soldering to a conductive portion such as a conductive circuit pattern formed on the substrate 51, In the manner which will later become clear, the strengthening members 31 are fixed to the substrate 51.

Figure 3:
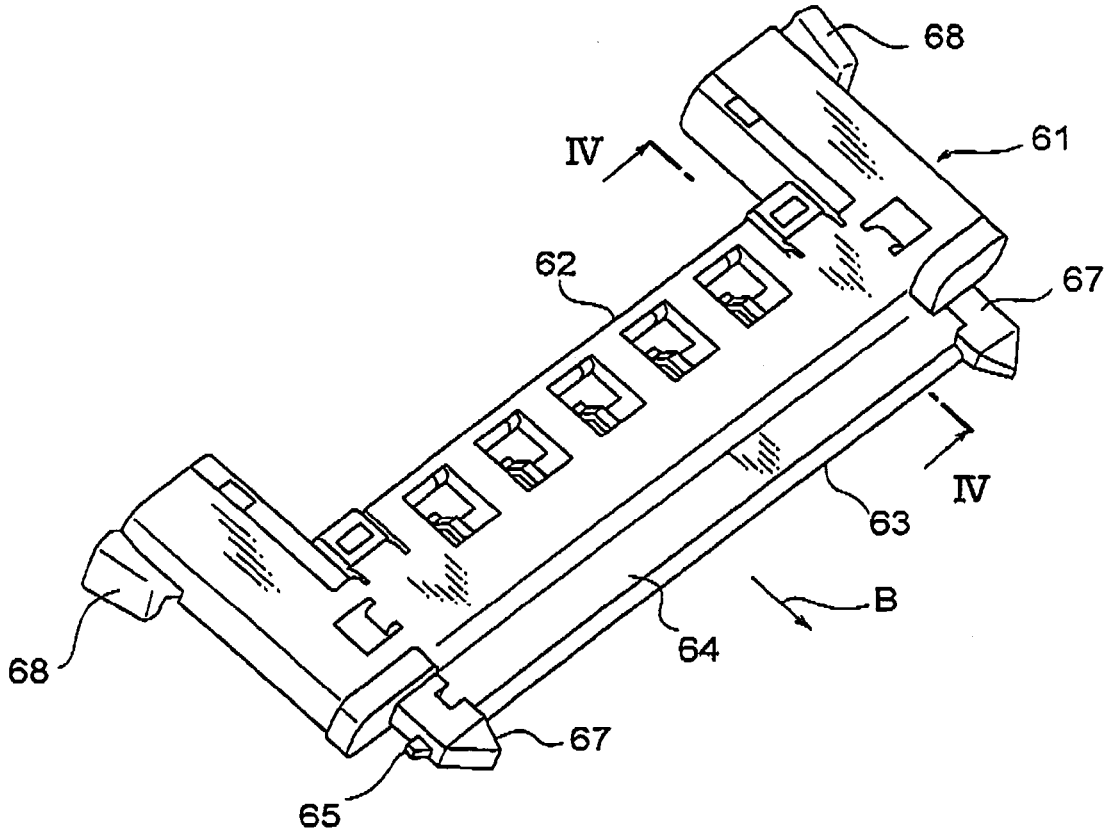
FIG. 3 is a perspective view of a mating connector to be fitted to the connector illustrated in FIG. 1.
Figure 4:
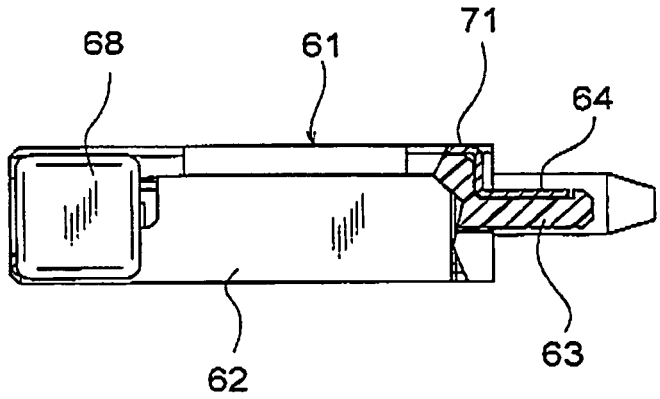
FIG. 4 is a partial sectional view of the mating connector in FIG. 3, taken along a line IV-IV in FIG. 3.
Figure 5:
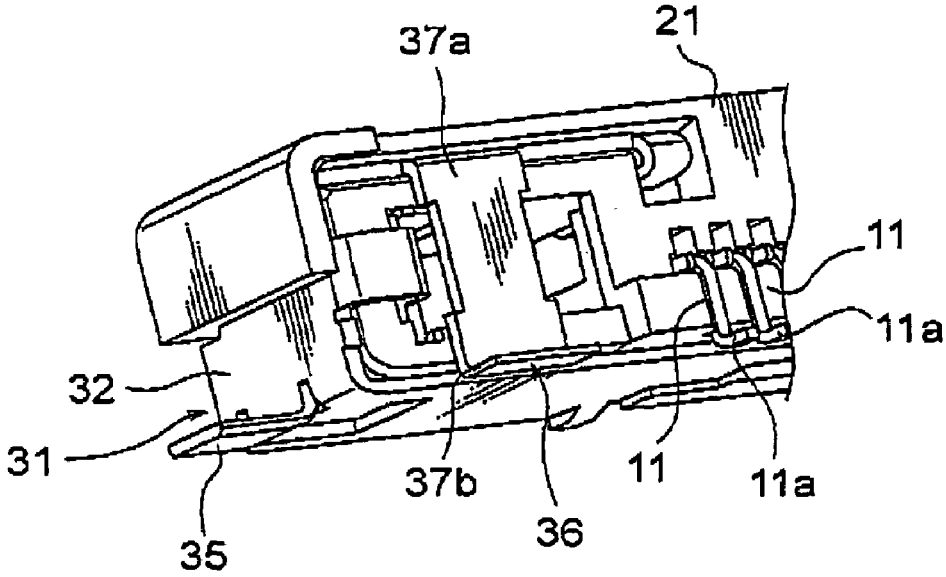
FIG. 5 is an enlarged perspective view of a characteristic part of the connector illustrated in FIG. 1.
Figure 6:
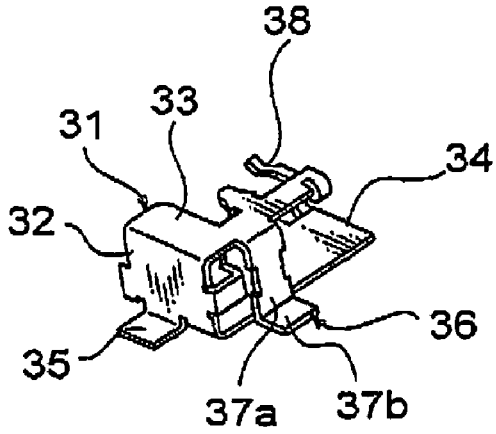
FIG. 6 is a perspective view of a strengthening member in the connector illustrated in FIG. 1.

The connector 1 is a receptacle connector and is connected to a mating connector 61 as a plug connector illustrated in FIGS. 3 and 4. The mating connector 61 has a housing 62, a mating fitting portion 63, and a conductive shell 71 covering an outer surface of the housing 62. A part of the shell 71 extends along the mating fitting portion 63 so as to serve as a ground portion 64. When the mating connector 61 is positioned and moved relative to the connector 1 in a fitting direction B perpendicular to the widthwise direction, the mating fitting portion 63 is fitted to the fitting portion 23.

The mating fitting portion 63 comprises a plurality of mating contacts (not shown) each to be contacted with the contacting portion of each of the conductive contacts 11 of the connector 1 upon fitting. The mating fitting portion 63 is provided with a pair of inserting portions 67 formed on longitudinal opposite sides thereof to be inserted into spaces on longitudinal opposite sides of the fitting portion 23. Outside the inserting portions 67, a pair of locking portions 65 are formed to be movable inward and outward in the widthwise direction B.

Referring to FIGS. 5 to 8 in addition, the strengthening members 31 will be described.

Each of the strengthening members 31 has a side plate portion 32 vertically extending in a direction away from the substrate 51 when the connector 1 is mounted to the substrate 51, a top plate portion 33 adjacent to the side plate portion 32 and faced to the substrate 51, and a bottom plate portion 34 extending in parallel to the top plate portion 33 with a space left therefrom. Thus, the top plate portion 33 and the bottom plate portion 34 are positioned in parallel to each other with their one sides connected to the side plate portion 32.

The strengthening member 31 further has first and second mounting portions 35 and 36 to be connected by soldering to a soldering portion (not shown) of the substrate 51, and a ground connecting portion 38 to be connected to the ground portion 64 of the mating connector 61.

At each of opposite ends of the housing 21 in the widthwise direction A, i.e., at each of longitudinal opposite sides of the housing 21, the first mounting portion 35 extends from an end of the side plate portion 32 which is adjacent to the substrate 51. The second mounting portion 36 has a connecting portion 37*a* which is formed on an opposite side opposite to a fitting side to be fitted to the mating connector 61 in the fitting direction B, i.e., opposite to the fitting portion 23 and which extends from the top plate portion 32 towards the substrate 51, and a plate-like mounting end portion 37*b* bent from an extending end of the connecting portion 37*a* and extending in the fitting direction B Thus, the second mounting portion 36 has a shape hanging down from a position near an upper surface of the housing 21 towards the substrate 51.

The first mounting portions 35 are located on the longitudinal opposite sides of the housing 21 and, therefore, prevent the housing 21 as a whole from floating up after the first mounting portions 35 are soldered to the substrate 51. The second mounting portions 36 have a shape hanging down from the position near the upper surface of the housing 21 towards the substrate 51 and, therefore, prevent the rear surface 25 of the housing 21 from floating up after the second mounting portions 36 are soldered to the substrate 51. Thus, the first and the second mounting portions 35 and 36 serve to increase a mechanical strength for being held by the substrate 51.

The ground connecting portion 38 is positioned in the fitting portion 23 and extends in a cantilevered fashion from the top plate portion 33 in a direction opposite the fitting direction B at a level stepped down from the top plate portion 33 towards the bottom plate portion 34. Thus, the ground connecting portion 38 is integrally formed with the top plate portion 33. Therefore, it is possible to increase the holding strength when the connector I is mounted and fixed to the substrate 51. Since the ground connecting portion 38 is integrally formed with the strengthening member 31, working is easy and the number of parts is reduced.

Figure 7:
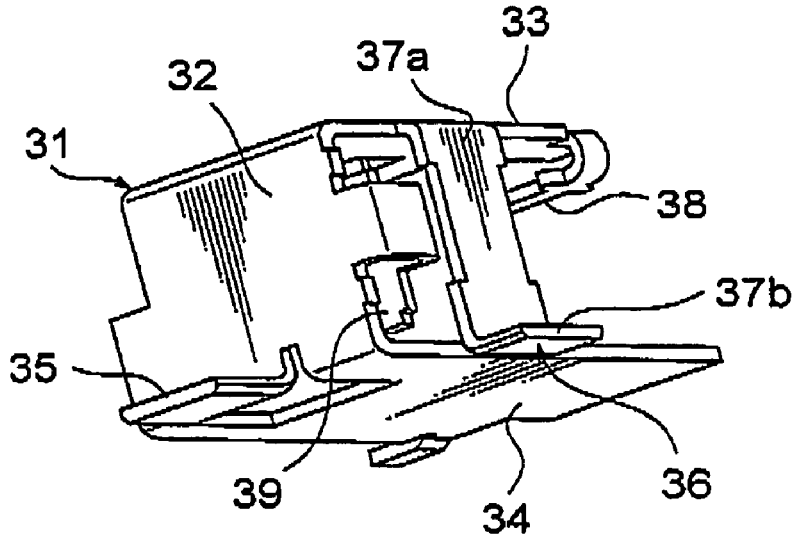
FIG. 7 is an enlarged perspective view of the strengthening member as seen in another direction.

As best shown in FIG. 7, the strengthening member 31 has a locked portion 39 faced to the side plate portion 32. The locked portion 39 Is provided with a locking hole 39*a* to be engaged with the locking portion 65 of the mating connector 61 upon fitting.

The above-mentioned strengthening member 31 may be produced by punching a conductive metal plate and then bending the metal plate.

Figure 9:
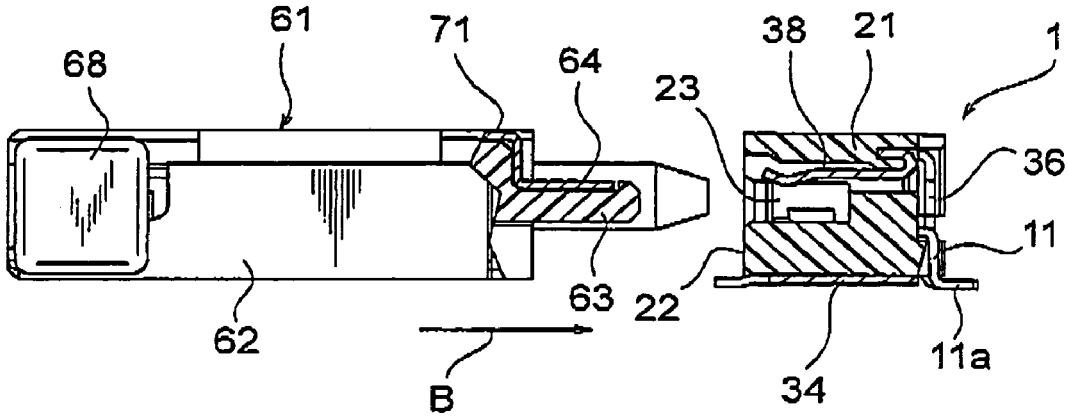
FIG. 9 is a partial sectional view showing a state before the connector in FIG. 1 and the mating connector in FIG. 3 are fitted to each other.
Figure 10:
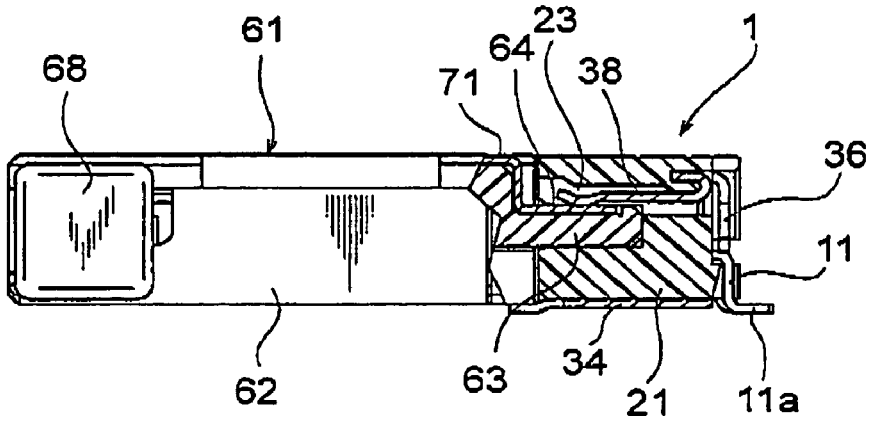
FIG. 10 is a partial sectional view similar to FIG. 9 and showing a state after the connector and the mating connector are fitted to each other.

Referring to FIGS. 9 and 10 in addition, description will be made of an operation of connecting the connector 1 and the mating connector 61.

At first, as illustrated in FIG. 9, the mating fitting portion 63 of the mating connector 61 is faced to the mating portion 23 of the connector 1. Then, the mating connector 61 is moved in the fitting direction B to fit the mating fitting portion 63 of the mating connector 61 to the fitting portion 23 of the connector 1.

As illustrated in FIG. 10, when the mating fitting portion 63 of the mating connector 61 is fitted to the fitting portion 23 of the connector 11 the mating fitting portion 63 of the mating connector 61 is located between the bottom plate portion 34 and the ground connecting portion 38. At this time, since the ground connecting portion 38 has elasticity, the ground connecting portion 38 is connected to the ground portion 64 of the mating connector 61 In the state where the ground portion 64 is pressed against the bottom plate portion 34.

Figure 8:
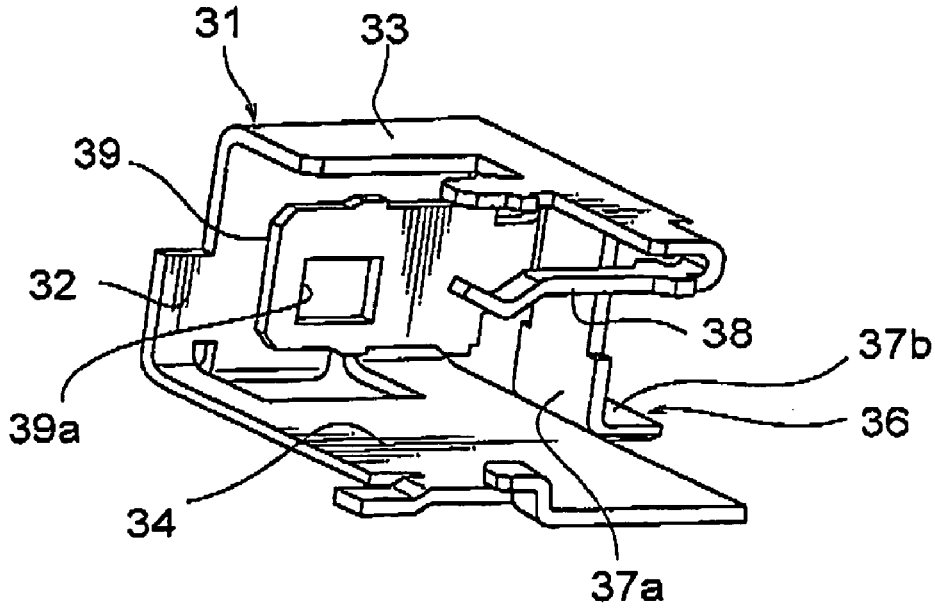
FIG. 8 is an enlarged perspective view of the strengthening member as seen in still another direction.

Referring to FIGS. 3 and 8 in addition, description will be made of locking between the connector 1 and the mating connector 61.

The locking portion 65 illustrated in FIG. 3 is butted to a plate surface of the locked portion 39 illustrated in FIG. 8 in the middle of operation of fitting the mating fitting portion 63 of the mating connector 61. At this time, the locking portion 65 is pressed by the plate surface of the locked portion 39 to be moved towards the inserting portion 67.

Further, when the mating fitting portion 63 of the mating connector 61 is fitted to the fitting portion 23 of the connector 1, the locking portion 65 is inserted into the locking hole 39*a*. Then, pressing by the plate surface of the locked portion 39 is released and the locking portion 65 is engaged with the locking hole 39*a* so as to inhibit removal of the mating fitting portion 63 in a direction opposite to the fitting direction B.

When a pair of operating portions 68 of the mating connector 61 are pressed and operated, the locking portion 65 is retreated towards the inserting portion 67 by an unlocking mechanism (not shown) to be disengaged from the locking hole 39*a*. Therefore, the mating connector 61 can easily be removed from the connector 1.

While the present invention has thus far been described in connection with a single embodiment thereof, It will readily be possible for those skilled in the art to put this invention into practice in various other manners. For example, it will readily be understood that this invention may be implemented in a connector having a single contact although the description has been made in conjunction with the connector having plural contacts.

What is claimed is:

1. A connector to be mounted to a substrate, comprising:

a conductive contact;

an insulating housing holding the contact; and a strengthening member coupled to the housing and adapted to fix the housing to the substrate;

wherein the strengthening member comprises:

a side plate portion which extends in a direction away from the substrate when the connector is mounted to the substrate;

a top plate portion extending from the side plate portion and faced to the substrate;

a bottom plate portion, which is faced to the top plate portion with a space therebetween, and which is connected to the side plate portion; and first and second mounting portions to be attached to the substrate;

wherein the first mounting portion extends, in a plane, from an end of the side plate portion adjacent to the substrate in a widthwise direction of the housing perpendicular to a fitting direction in which a mating connector is fitted to the connector; and wherein the second mounting portion extends from the top plate portion at a side of the connector opposite to a fitting side of the connector to be fitted to the mating connector, and the second mounting portion comprises a connecting portion which extends from the top plate portion towards the substrate and a mounting end portion which extends in the fitting direction from an extending end of the connecting portion, and wherein the mounting end portion of the second mounting portion extends in the same plane as the first mounting portion.

2. The connector according to claim 1, wherein the strengthening member further comprises a conductive ground connecting portion adapted to be connected to a ground portion of the mating connector.

3. The connector according to claim 2, wherein the ground connecting portion extends from the top plate portion.

4. The connector according to claim 1, wherein the strengthening member further comprises a locked portion adapted to be engaged with a locking portion of the mating connector.

5. The connector according to claim 4, wherein the bottom plate portion is between the top plate portion and the substrate, and wherein the locked portion extends from the side plate portion to a position between the top plate portion and the bottom plate portion.

* * * * *